United States Patent [19]

Pilipovich

[11] 3,963,542

[45] June 15, 1976

[54] OXIDIZER COMPATIBLE SOLID PROPELLANT FLUORINE ATOM GAS GENERATOR

[75] Inventor: Donald Pilipovich, Agoura, Calif.

[73] Assignee: Rockwell International Corporation, El Segundo, Calif.

[22] Filed: Oct. 18, 1973

[21] Appl. No.: 407,715

[52] U.S. Cl. ..... 149/19.3; 149/20; 149/74; 149/109.2; 149/119

[51] Int. Cl.[2] ..... C06B 31/00; C06B 27/00; C06B 43/00; C06B 45/10

[58] Field of Search ..... 149/19.3, 109.2, 74, 149/20, 119

[56] References Cited

UNITED STATES PATENTS

| | | | |
|---|---|---|---|
| 3,399,087 | 8/1968 | Scigliano | 149/19.9 |
| 3,520,742 | 7/1970 | Witz | 149/19.1 X |
| 3,732,132 | 5/1973 | Merrow et al. | 149/19.3 |
| 3,752,703 | 8/1973 | Toy et al. | 149/19.1 |
| 3,797,238 | 3/1974 | Iwanciow et al. | 149/19.3 X |
| 3,833,432 | 9/1974 | Moy et al. | 149/19.3 |

OTHER PUBLICATIONS

Goetschel et al., *Inorganic Chemistry*, 11, pp. 1696–1701 (1972).

Christe et al., *Inorganic Chemistry*, 12, pp. 2478–2481 (1973).

*Primary Examiner*—Edward A. Miller

*Attorney, Agent, or Firm*—L. Lee Humphries; Robert M. Sperry

[57] ABSTRACT

A solid propellant gas generator system employing fluorocarbons as the primary binder and fuel and oxidizing salt wherein the oxidizing power resides in the cation to provide ozidizer-compatible combustion products. The thermal output may be tailored by adding small quantities of boron or carbon fuels and the composition of the combustion products may be tailored by varying the ratio of the fluorocarbon to the oxidizer.

8 Claims, No Drawings

OXIDIZER COMPATIBLE SOLID PROPELLANT FLUORINE ATOM GAS GENERATOR

BACKGROUND OF THE INVENTION AND PRIOR ART

This invention relates to compositions of matter and is particularly directed to compositions of matter for use as oxidizer-compatible solid propellant gas generator systems. Specific compositions are described which provide fluorine atoms in the exhaust such that it is suitable in continuous wave chemical laser applications.

Solid propellant gas generators have become widely used for a multiplicity of purposes and numerous types of solid propellant gas generators have been proposed heretofore. However, the solid propellant gas generator systems of the prior art have yielded combustion products which react violently with oxidizer materials or form components which are explosive or incombustible, or otherwise alter or degrade the function of the oxidizer. Unfortunately, there are many applications for solid propellant gas generators in which such reactions with the oxidizer materials cannot be tolerated. Thus, where solid propellant gas generators are employed for pressurizing positive expulsion tanks in the fuel systems of space vehicles, leaks may develop in the tanks which would allow mixing of the combustion products of the gas generator with the oxidizer of the space vehicle fuel system and could result in explosion of the vehicle. Further, the prior art does not describe a solid propellant which generates fluorine atoms, along with fully oxidized coproducts, which are instrumental for reaction with $H_2$ or $O_2$ in a HF or DF chemical laser.

BRIEF SUMMARY AND OBJECTS OF INVENTION

These disadvantages of the prior art are overcome with the present invention and a solid propellant gas generator system is proposed which yields combustion products which are compatible with oxidizer materials. The absence in the prior art of a suitable fluorine atom generator is also overcome with the embodiments of this invention.

The advantages of the present invention are preferably attained by providing a solid propellant gas generator system comprising a fluorocarbon as both the primary fuel and binder and an oxidizing salt wherein the oxidizing power resides in the cation. The thermal output of the gas generator can be tailored by adding small quantities of secondary fuel materials, such as boron or carbon, and the composition of the combustion products may be tailored by varying the ratio of the fluorocarbon to the oxidizer.

Accordingly, it is an object of the present invention to provide new compositions of matter.

Another object of the present invention is to provide improved solid propellant gas generator systems.

An additional object of the present invention is to provide solid propellant gas generator systems yielding combustion products which are oxidizer-compatible.

Another object of the invention is to provide a composition which acts as a solid propellant fluorine atom gas generator for continuous wave HF (or DF) chemical laser applications.

A specific object of the present invention is to provide a solid propellant gas generator system comprising a fluorocarbon as the primary binder and fuel and an oxidizer wherein the oxidizing power resides in the cation.

These and other objects and features of the present invention will be apparent from the following detailed description.

DESCRIPTION OF THE INVENTION

In that form of the present invention chosen for purposes of illustration, a solid propellant gas generator system is proposed comprising a fluorocarbon as the primary binder and fuel and an oxidizer wherein the oxidizing power resides in the cation to provide combustion products which are compatible with oxidizer materials. The thermal output of the gas generator systems may be tailored by adding small quantities of auxiliary fuel materials, such as powdered boron or carbon, or appropriate compounds thereof. In addition, the composition of the combustion products of the gas generator systems may be tailored by varying the ratio of the fluorocarbon to the oxidizer.

EXAMPLE I

In a typical example of fluorine atom generation, samples of a solid propellant gas generator were produced for combustion and analysis consisting of a fluorocarbon powder, available commercially under the trade name "Fluoropak 80", from the Fluorocarbon Corporation, Anaheim, California, as a fuel and binder, together with $NF_4BF_4$ as an oxidizer.

The $NF_4BF_4$ was synthesized by the method of Tolberg et al, disclosed in AFRPL-68-47, Final Report, entitled *Synthesis of Energetic Oxidizers*, Stanford Research Institute, Menlo Park, California, Mar. 25, 1968. The resultant material, a white powder, was manipulated in an inert atmosphere chamber due to its hygroscopicity. Quantities of $NF_4BF_4$ were weighed on a torsion balance in a dry box and were intimately mixed with quantities of "Fluoropak 80". Theoretical calculations for various proportions were calculated using the method of J. M. Gerhauser and R. J. Thompson, Jr., published Aug. 3, 1964, in Report No. R-5802, entitled *Theoretical Performance Evaluating of Rocket Propellants*, by Rocketdyne Division, Rockwell International Corporation, Canoga Park, California, with the predicted exhaust compositions shown in Table 1.

Table 1

| Ingredients | Composition (weight percent) | Temperature °C | F | $BF_3$ | $CF_4$ | $NF_3$ | $N_2$ | $F_2$ |
|---|---|---|---|---|---|---|---|---|
| $NF_4BF_4$ | 68 | 1325 | 32.6 | 20.9 | 34.8 | — | 10.5 | 1.1 |
| Fluoropak 80 | 32 | | | | | | | |
| $NF_4BF_4$ | 66 | 1544 | 28.6 | 21.4 | 39.0 | — | 10.7 | .3 |
| Fluoropak 80 | 34 | | | | | | | |
| $NF_4BF_4$ | 64 | 1787 | 22.6 | 22.1 | 44.0 | — | 11.1 | — |
| Fluoropak 80 | 36 | | | | | | | |
| $NF_4BF_4$ | 70 | 1161 | 32.7 | 20.9 | 31.7 | — | 10.5 | 4.2 |
| Fluoropak 80 | 30 | | | | | | | |
| $NF_4BF_4$ | 60 | 2106 | 10.8 | 23.0 | 52.0 | — | 11.6 | — |

Table 1-continued

| Ingredients | Composition (weight percent) | Temperature °C | F | $BF_3$ | $CF_4$ | $NF_3$ | $N_2$ | $F_2$ |
|---|---|---|---|---|---|---|---|---|
| Fluoropak 80 | 40 | | | | | | | |
| $NF_4BF_4$ | 50 | 2000 | 1.0 | 19.7 | 53.8 | — | 9.8 | — |
| Fluoropak 80 | 50 | | | | | | | |

TABLE 2

| Ingredients | Composition (weight percent) | F | $BF_3$ | $CF_4$ | $N_2$ |
|---|---|---|---|---|---|
| $NF_4BF_4$ | 64 | 18.5 | 18.4 | 53.0 | 10.1 |
| Fluoropak 80 | 36 | | | | |
| $NF_4BF_4$ | 68 | 25.2 | 18.2 | 46.5 | 9.1 |
| Fluoropak 80 | | | | | |

The mixtures for testing were pressed into ⅜ inch diameter pellets using a Para Pellet press, available commercially from Van Waters and Rogers Co., Los Angeles, California. The pellets were placed into a Molecular Beam System used for generating low pressure sample gases for mass spectrometer analysis. The Molecular Beam System is described by B. Goshgarian and W. Solomon, AFRPL-TR-72-30, Technical Report entitled, *Molecular Beam Systems*, April 1972. The Molecular beam System was connected to a cross-beam time of flight analyzer, available as Model MA3 from Bendix Corporation, Scientific Instrument and Equipment Division, Rochester, New York. The samples were ignited by a hot wire at atmospheric pressure and scans were taken with the mass spectrometer operating at 26 ev to measure the quantities of $CF_4$, $NF_3$, $F_2$, and F present in the products of combustion. The results are shown in Table 2.

It will be apparent that the composition of the combustion products can be tailored considerably by varying the ratio of the fluorocarbon fuel binder to the $NF_4BF_4$ oxidizer. Where the $NF_4BF_4$ oxidizer accounts for more than about 64% of the total composition, the solid propellant gas generator yields substantial quantities of atomic fluorine, which is extremely useful in HF or DF chemical lasers. In contrast, where the fluorocarbon fuel/binder accounts for more than about 50% of the total composition, the combustion products contain no fluorine and non-reactive gases with substantially all known oxidizer materials. Consequently, these high fluorocarbon formulations are well suited for pressurizing positive expulsion systems and other such uses.

As indicated in Table 1, the thermal output of the solid propellant gas generator may be tailored by varying the ratio of the fluorocarbon fuel/binder with respect to the oxidizer. Higher thermal outputs can be obtained by substituting up to about 15 percent by weight of the fluorocarbon or oxidizer, or a combination of the two, with a suitable metallic fuel, such as powdered boron or carbon, or compounds thereof, such as boron carbide. Thus, a solid propellant gas generator system consisting of 78 weight percent of $NF_4BF_4$, 20 weight percent of fluorocarbon and 2 weight percent boron carbide burns at a temperature of 2271°C and produces theoretical combustion products as shown in Table 3.

TABLE 3

| F | $CF_4$ | $N_2$ | $F_2$ | $BF_3$ | $SiF_4$ |
|---|---|---|---|---|---|
| 40 | 21 | 11 | — | 28 | — |

Other oxidizers, wherein the oxidizing power resides in the cation, may, if desired, be substituted for the $NF_4BF_4$ oxidizer. Thus, for example, other salts derived from Lewis acids and $NO_2F$ are useful as oxidizers for the solid propellant gas generator systems of the present invention. Stable salts formed from the reaction $$NO_2F + MF_{(y-1)} \rightarrow NO_2MF_y$$

where *M* is a Lewis acid are described by C. Woolf in *Advances in Fluorine Chemistry*, Volume 5, Butterworth's, Washington, D.C. (pages 18–19). Among the compounds which are useful in producing oxidizing salts with this reaction are $NO_2PF_6$; $NO_2A_5F_6$;$NO_2SbF_6$; $(NO_2)_2SiF_6$; $(NO_2)_2GeF_6$; and $(NO_2)_2SnF_4$. All of these salts react with fluorocarbons at high temperature to yield gaseous combustion products which are non-reactive with known oxidizing materials. However, it is preferable to employ the lower molecular weight Lewis acids in order to assure good volatility of the combustion products.

Obviously, numerous other variations and modifications may be made without departing from the present invention. Accordingly, it should be clearly understood that the forms of the present invention described above are illustrative only and are not intended to limit the scope of the present invention.

What is claimed is:

1. The method of generating fluorine atom gas, said method comprising the step of:

burning a fluorocarbon as the binder and primary fuel source in the presence of a fluorine-containing oxidizer material having the oxidizing power contained substantially in the cation thereof.

2. The method of claim 1 wherein said oxidizer material is produced from the reaction of $NO_2F$ with a Lewis acid which is gaseous at the decomposition temperature.

3. The method of claim 1 wherein said oxidizer material is produced by the reaction $$NO_2F + MF_{(y-1)} \rightarrow NO_2MF_y$$

where M is a Lewis acid which is gaseous at the decomposition temperature.

4. A solid propellant fluorine atom gas generator system comprising:

a fluorocarbon as the binder and primary fuel source, and $NF_4BF_4$ as a fluorine-containing oxidizer material having the oxidizing power contained substantially in the cation thereof.

5. The gas generator system of claim 4 wherein said oxidizer material comprises more than about 50% by weight of said gas generator system.

6. The gas generator system of claim 4 wherein said fluorocarbon comprises up to about 50% by weight of said gas generator system.

7. A solid propellant fluorine atom gas generator system consisting of:

about 50–70 weight percent of a fluorine-containing oxidizer material having the oxidizing power contained substantially in the cation thereof, about 30–50 weight percent of a fluorocarbon as a binder and primary fuel source, and more than about 0 but less than about 15 weight percent of a powdered metal auxiliary fuel.

8. The method of generating fluorine atom gas, said method comprising the step of:

burning a fluorocarbon as the binder and primary fuel source in the presence of $NF_4BF_4$ as an oxidizer.

* * * * *